US007571589B2

(12) United States Patent
Shaw et al.

(10) Patent No.: US 7,571,589 B2
(45) Date of Patent: Aug. 11, 2009

(54) APPARATUS FOR AND METHOD OF PRODUCING AND/OR SEPARATING A STRING OF INTERCONNECTED PACKING CUSHIONS

(75) Inventors: Kenneth L. Shaw, Anaheim, CA (US); Adolf Wegmann, Long Beach, CA (US)

(73) Assignee: Storopack, Inc., Cincinnati, OH (US)

( * ) Notice: Subject to any disclaimer, the term of this patent is extended or adjusted under 35 U.S.C. 154(b) by 953 days.

(21) Appl. No.: 10/891,850

(22) Filed: Jul. 15, 2004

(65) Prior Publication Data

US 2006/0010835 A1 Jan. 19, 2006

(51) Int. Cl.
*B65B 31/04* (2006.01)
*B31F 7/00* (2006.01)
*B65H 35/10* (2006.01)

(52) U.S. Cl. ..... 53/403; 53/79; 493/28; 493/372; 225/100

(58) Field of Classification Search ..... 53/403, 53/435, 493, 79; 225/97, 101, 100, 106; 493/2, 27, 28, 340, 369, 372; 198/461.2, 198/626.1, 626.3
See application file for complete search history.

(56) References Cited

U.S. PATENT DOCUMENTS 2,718,105 A * 9/1955 Ferguson et al. ..... 53/548
2,800,180 A * 7/1957 Jensen ..... 225/4
3,667,593 A 6/1972 Pendleton ..... 206/46
3,730,411 A * 5/1973 Brockmuller ..... 225/100
4,384,442 A * 5/1983 Pendleton ..... 53/554
4,493,684 A 1/1985 Bolton ..... 493/234
4,606,534 A * 8/1986 Gombault ..... 270/52.11
4,674,268 A * 6/1987 Gavronsky et al. ..... 53/468
4,847,126 A * 7/1989 Yamashiro et al. ..... 428/35.2
5,230,453 A 7/1993 Meschi ..... 225/100
5,464,142 A * 11/1995 Mol et al. ..... 225/100
5,581,983 A * 12/1996 Murakami ..... 53/512
5,660,662 A * 8/1997 Testone ..... 156/145
5,766,736 A 6/1998 Baumuller ..... 428/198
5,897,478 A * 4/1999 Harding et al. ..... 493/22
5,897,481 A 4/1999 Baumuller ..... 493/464
5,942,076 A * 8/1999 Salerno et al. ..... 156/359
6,033,354 A 3/2000 Baumuller ..... 493/464

(Continued)

FOREIGN PATENT DOCUMENTS

EP 1563987 8/2005

*Primary Examiner*—Paul R Durand
(74) *Attorney, Agent, or Firm*—Wood, Herron & Evans, LLP

(57) ABSTRACT

Apparatus for producing and separating a string of interconnected packing cushions comprises a packing cushion production machine which produces a string of interconnected packing cushions, the string of interconnected packing cushions exiting an output end of the machine at a first velocity, and a separation device associated with the output end of the machine, the separation device adapted to selectively engage the string of interconnected packing cushions and to drive the string at a second velocity, greater than the first velocity, and in doing so to cause the string of interconnected packing cushions to separate. The method comprises producing a string of interconnected packing cushions, or supplying a pre-produced string of interconnected packing cushions, the string of interconnected packing cushions traveling at a first velocity, and selectively engaging the string of interconnected packing cushions at a second velocity, greater than the first velocity, and in doing so causing the string of interconnected packing cushions to separate.

30 Claims, 3 Drawing Sheets

U.S. PATENT DOCUMENTS

| | | | | |
|---|---|---|---|---|
| RE36,759 | E * | 7/2000 | Hoover et al. | 156/147 |
| 6,106,452 | A | 8/2000 | Baumuller | 493/464 |
| 6,170,227 | B1 | 1/2001 | Kovacs et al. | 53/64 |
| 6,199,349 | B1 | 3/2001 | Lerner | 53/472 |
| 6,341,473 | B1 | 1/2002 | Kovacs et al. | 53/450 |
| 6,453,644 | B1 | 9/2002 | Baker | 53/403 |
| 6,519,916 | B1 | 2/2003 | Brown | 53/403 |
| 6,534,148 | B1 | 3/2003 | Baumuller | 428/126 |
| 6,536,183 | B1 | 3/2003 | Brown | 53/79 |
| 6,582,800 | B2 | 6/2003 | Fuss et al. | 428/178 |
| 6,598,373 | B2 * | 7/2003 | Sperry et al. | 53/403 |
| 6,659,150 | B1 * | 12/2003 | Perkins et al. | 156/378 |
| 6,672,033 | B2 | 1/2004 | Brown | 53/403 |
| 7,325,377 | B2 * | 2/2008 | Fuss et al. | 53/403 |
| 7,389,626 | B2 * | 6/2008 | Sperry et al. | 53/403 |

* cited by examiner

APPARATUS FOR AND METHOD OF PRODUCING AND/OR SEPARATING A STRING OF INTERCONNECTED PACKING CUSHIONS

FIELD OF THE INVENTION

This invention relates generally to protective packaging products, and more specifically to an apparatus for and a method of producing and separating, or just separating, a string of interconnected packing cushions, for example air filled plastic pillows, into a desired length of cushions.

BACKGROUND OF THE INVENTION

In the process of shipping an item from one location to another, a protective packaging material is typically placed in the shipping carton or box, to fill any voids and/or to cushion the item during the shipping process. One such protective packaging material is air filled cushions/pillows. Air filled pillows may be produced by a variety of commercially available air pillow production machines.

One practice of handling, i.e. conveying, and storing air pillows for their use after their production is to utilize a mechanical conveyor, i.e. conveyor belt, which mechanically conveys the air pillows from the air pillow production machine to a storage hopper. Another method is to pneumatically convey the air pillows to the storage hopper. In either event, a packer pulls the end of the string of air pillows from the storage hopper and then tears off a selected length, assisted by the perforations which separate adjacent air pillows, to place in the box.

It is desirable to eliminate the step of manually tearing off a selected length of the air pillows.

SUMMARY OF THE INVENTION

The present invention is both an apparatus for and a method of producing and/or separating a string of interconnected packing cushions. The apparatus comprises a packing cushion production machine which produces a string of interconnected packing cushions, the string of interconnected packing cushions exiting an output end of the machine at a first velocity, and a separation device associated with the output end of the machine, the separation device adapted to selectively engage the string of interconnected packing cushions and to drive the string at a second velocity, greater than the first velocity, and in doing so to cause the string of interconnected packing cushions to separate.

The packing cushions can be air filled plastic pillows. The air filled plastic pillows can have transverse seal lines between adjacent ones of the pillows. The air filled plastic pillows can also have transverse lines of weakening between adjacent ones of the pillows, for example, perforations, slits, scoring or thinning.

The separation device can comprise a first moving surface adapted to contact one side of the string of interconnected packing cushions and a second moving surface adapted to be selectively placed into and out of contact with the other side of the string of interconnected packing cushions. The first and second moving surfaces can be rollers or belts.

The separation device can also comprise first and second pairs of opposed moving surfaces. The first pair of opposed moving surfaces can comprise a first moving surface adapted to contact one side of the string of interconnected packing cushions and a second moving surface adapted to contact the other side of the string of interconnected packing cushions, the first pair of opposed moving surfaces advancing the string of interconnected packing cushions a first velocity. The second pair of opposed moving surfaces can comprise a third moving surface adapted to contact the one side of the string of interconnected packing cushions and a fourth moving surface adapted to be selectively placed into and out of contact with the other side of the string of interconnected packing cushions, the second pair of opposed moving surfaces advancing the string of interconnected packing cushions a second velocity, the second velocity being greater than the first velocity. When the fourth moving surface is placed into contact with the other side of the string of interconnected packing cushions the string of interconnected packing cushions separate.

The fourth moving surface can be manually placeable into and out of contact with the string of interconnected packing cushions via an operator, or an actuator can be operably mounted between the packing cushion production machine and the fourth moving surface for placing the fourth moving surface into and out of contact with the string of interconnected packing cushions. The actuator can be, for example, a solenoid. A counting device can time activation of the actuator in order to obtain a selected length of the interconnected packing cushions. The counting device can be, for example, a timer or an encoder. The apparatus can further include a processor/controller which receives a signal from the counting device and sends a signal to the actuator in response thereto to activate the actuator in order to obtain the selected length of the interconnected packing cushions.

The method for producing a string of interconnected packing cushions comprises producing a string of interconnected packing cushions, the string of interconnected packing cushions traveling at a first velocity, and selectively engaging the string of interconnected packing cushions at a second velocity, greater than the first velocity, and in doing so causing the string of interconnected packing cushions to separate.

In another aspect, the invention is a combination of a string of interconnected packing cushions and a separation device for separating the string of cushions. The separation device engages the string of cushions at an upstream position, the string of cushions having a first velocity at the upstream position. The device also engages the string of cushions at a downstream position, the string of cushions having a second velocity at the downstream position, greater than the first velocity. The device thereby causes the string of cushions to separate.

In yet another aspect, the invention is a method of separating a string of interconnected packing cushions. The method comprises providing a string of interconnected packing cushions, engaging the string of cushions at an upstream position, the string of cushions having a first velocity at the upstream position, and engaging the string of cushions at a downstream position, the string of cushions having a second velocity at the downstream position, greater than the first velocity, thereby causing the string of interconnected packing cushions to separate.

In still another aspect, the invention is a combination of a string of interconnected packing cushions and a separation device for separating the string of interconnected packing cushions. The separation device comprises a first upstream pair of opposed surfaces and a second downstream pair of opposed surfaces. At least one surface of each pair is a moving surface. The moving surface of the first upstream pair advances the string of interconnected packing cushions at a first velocity, while the moving surface of the second downstream pair advances the string of interconnected packing cushions at a second velocity, greater than the first velocity, the device thereby causing the string of interconnected packing cushions to separate.

These and other features and advantages of the present invention will become more readily apparent during the following detailed description taken in conjunction with the drawings herein, in which:

DETAILED DESCRIPTION OF THE INVENTION

Figure 1:
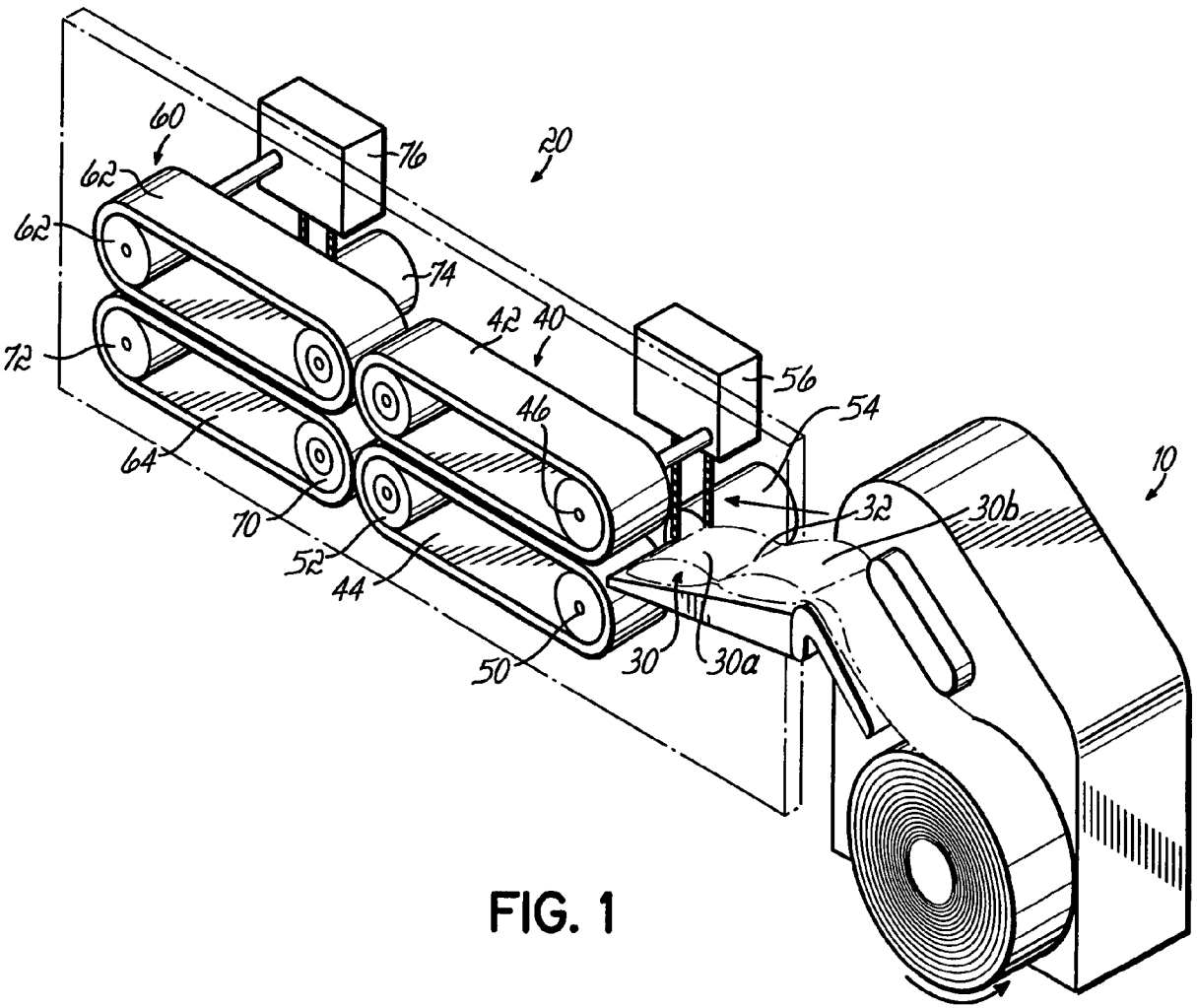
FIG. 1 is a perspective view of the apparatus of the present invention.
Figure 2:
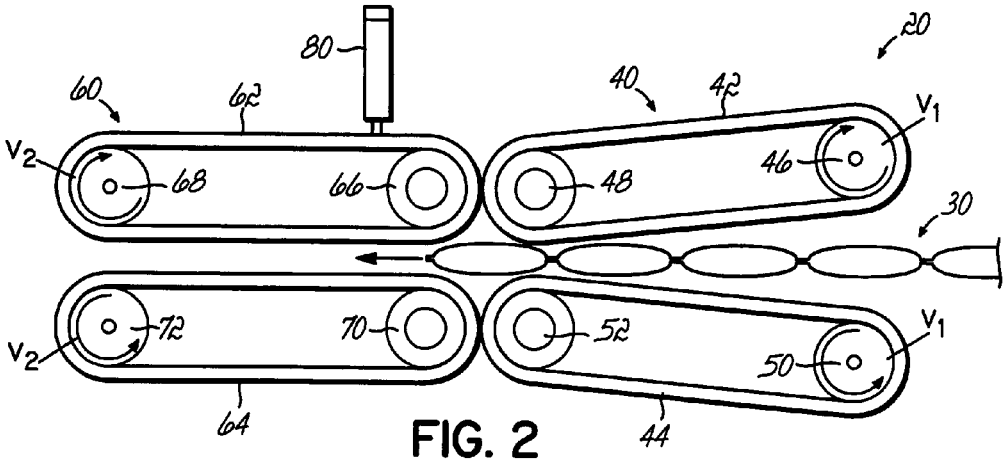
FIGS. 2-4 are side views of the apparatus of the present invention in sequence of operation.
Figure 3:
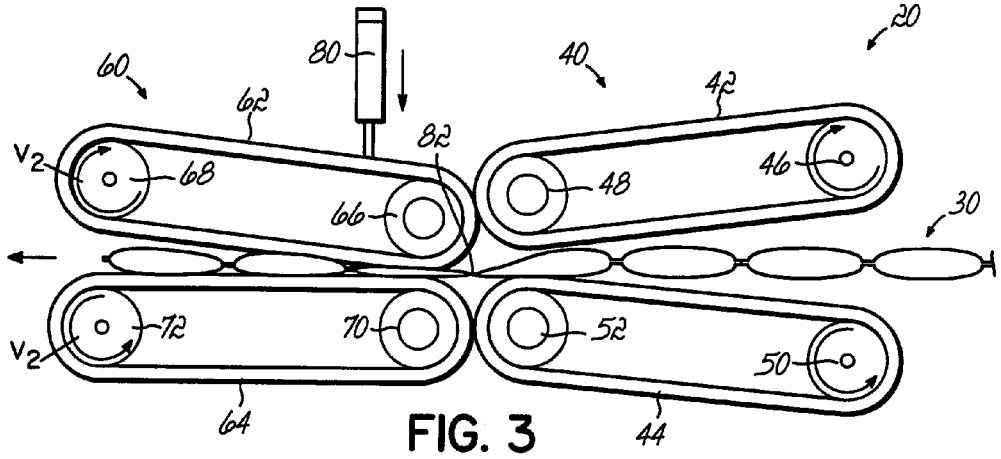
Figure 4:
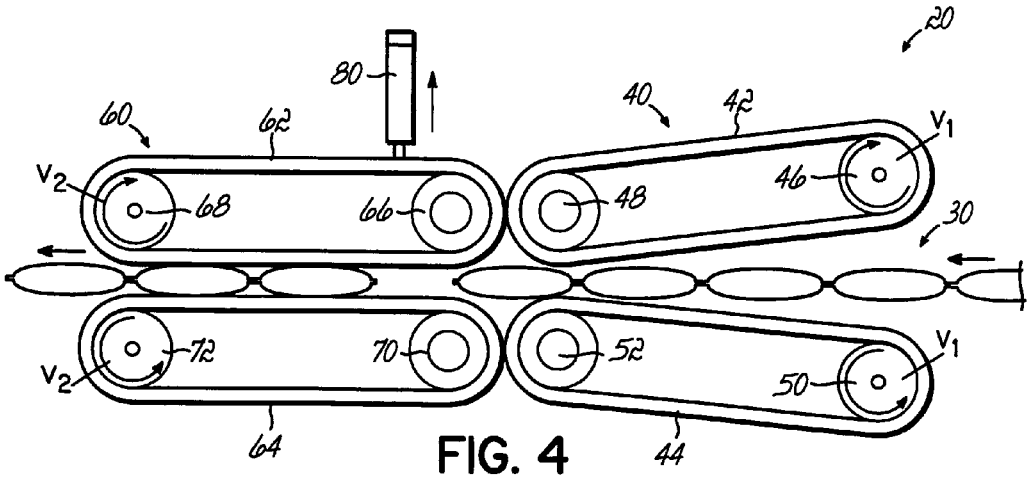

Referring first to FIG. 1, there is illustrated a packing cushion production machine 10 and a separation device 20. Packing cushion production machine 10 can be, for example, the AIRplus® Excel commercially available from the assignee, which produces a string 30 of interconnected air pillows with adjacent ones of the pillows 30*a*, 30*b* separated by a line of perforations 32. The scope of the invention is not to be limited as requiring the AIRplus® Excel machine, as other machines which produce an interconnected string of packing cushions, be they air pillows or vented bags of loose-fill or other types of packing cushions, can also be employed. Furthermore, the scope of the invention is not to be limited as requiring a packing cushion production machine, as the separation device 20 can be employed separate and apart from such a machine. For example, a pre-produced interconnected string of packing cushions 30 can be fed to the separation device 20 from a storage/accumulation device such as a hopper, bag, table, etc.

Referring still to FIG. 1, the separation device 20 can comprise a first pair 40 of opposed surfaces 42, 44. Opposed surfaces 42, 44 can be, for example, belts which travel around rollers 46, 48 and 50, 52, respectively. Alternatively, the separation device 20 can be configured such that only one of the opposed surfaces is a moving surface, for example the lower surface could be a plate and the upper surface the moving belt. Rollers 46 and 50 can be driven rollers, with roller 50 driven by motor 54 and roller 46 driven by motor 54 through a gear box 56.

Referring still to FIG. 1, the separation device 20 can comprise a second pair 60 of opposed surfaces 62, 64. If device 20 is used in conjunction with machine 10, the invention can be practiced with just one such pair of opposed surfaces. For better separation efficiency when used with a cushion production machine, or when device 20 is used without a pillow production machine as in the case of separating a pre-produced string of cushions supplied from a hopper, bag, table, etc., two pairs of opposed surfaces can be employed. Opposed surfaces 62, 64 can be, for example, belts which travel around rollers 66, 68 and 70, 72, respectively. As mentioned above, the separation device 20 can be configured such that only one of the opposed surfaces is a moving surface, for example the lower surface could be a plate and the upper surface the moving belt. Rollers 66 and 70 can be driven rollers, with roller 72 driven by motor 74 and roller 68 driven by motor 74 through a gear box 76.

Referring now to FIGS. 1-4, the speeds of the motors 54 and 74 are selected such that driven rollers 46 and 50 rotate at a speed V1 which is slower than the speed V2 at which the driven rollers 66 and 70 rotate. Thus the upstream pair of belts 42, 44 have a slower linear velocity than the downstream pair of belts 62, 64. An actuator 80 is associated with upper belt 62 of the downstream pair of belts 62, 64 and is for selectively placing the upper belt 62 into and out of contact with the string of interconnected air pillows 30. Since belts 62 and 64 are traveling faster than belts 42 and 44, when actuator 80 places belt 62 into contact with the string of cushions 30 the pair of belts 62 and 64 cause the string to separate at the line of perforations 82 between the pairs of belts 42, 44 and 62, 64. The device 20 is operable to separate a string of cushions 30 with lines of weakening between adjacent ones of the cushions other than perforations, for example, slits, scoring, thinning, etc. Preferably belts 42 and 44 travel at about 34 feet per minute and belts 62, 64 travel at about 130 feet per minute.

Figure 5:
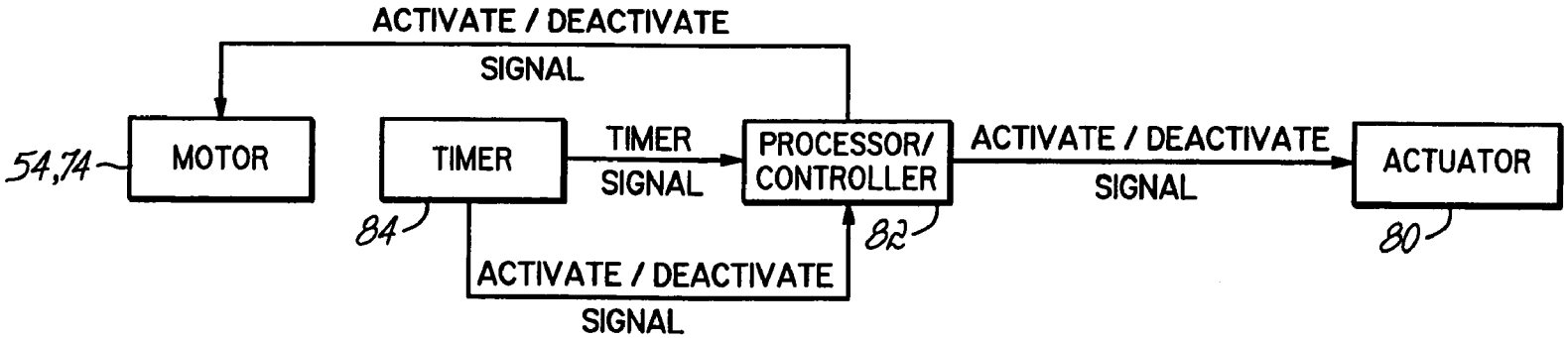
FIG. 5 is a block diagram of one control system for controlling the apparatus of the present invention.
Figure 6:
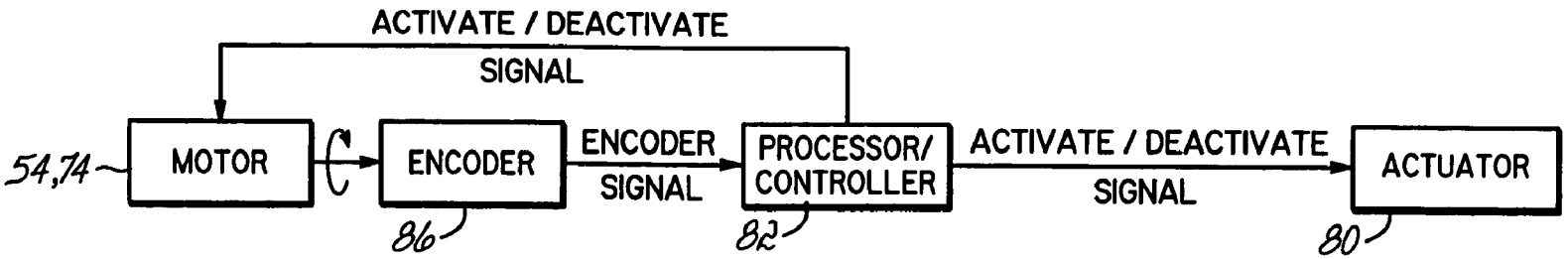
FIG. 6 is a block diagram of another control system for controlling the apparatus of the present invention.

Referring now to FIG. 5 there is illustrated a block diagram of one control system for use with the separation device 20. A processor/controller 82 sends start and stop signals to the motors 54 and 74, as well as activate/deactivate signals to the actuator 80. A counting device, for example timer 84, can be employed to time the activation of the actuator 80 via the processor/controller 82, to obtain a selected length of cushions. Alternatively, and as shown in FIG. 6, an encoder 86 operably associated with one of the motors 54, 74 can be employed as the counting device to time activation of the actuator 80 via the processor/controller 82. Still further, a mechanical counter such as a rocker arm that rests lightly on the string of bags could be employed. Each time a bag goes by, the arm is forced up, and then drops back down following the contour of the bag. Each cycle of the arm is counted as one bag.

The separation device of the present invention eliminates the need for a packer to manually separate a string of interconnected packing cushions into a shorter, selected length. Also, since the separation step is performed on a moving string of cushions, the moving string of cushions is continuously separated or separated "on the fly," thus speeding the operation.

Those skilled in the art will readily recognize numerous adaptations and modifications which can be made to the present invention which will result in an improved apparatus for and method of producing and/or separating a string of interconnected packing cushions, yet all of which will fall within the spirit and scope of the present invention as defined in the following claims. For example, the packing cushion production machine employed with the separator of the present invention could form the transverse seal lines and transverse lines of perforations, or the machine could be fed a roll of plastic film which already includes the transverse seal lines and transverse lines of perforations. Accordingly, the invention is to be limited only by the scope of the following claims and their equivalents.

What is claimed is:

1. Apparatus for producing a string of interconnected packing cushions, said apparatus comprising:

a packing cushion production machine which produces a string of interconnected packing cushions, the string of interconnected packing cushions exiting an output end of said machine at a first velocity, and a separation device associated with said output end of said machine, said separation device adapted to selectively engage the string of interconnected packing cushions and to drive the string at a second velocity, greater than the first velocity, and in doing so to cause the string of interconnected packing cushions to separate, wherein said separation device comprises a first moving surface adapted to contact one side of the string of interconnected packing cushions and a second moving surface adapted to be selectively placed into and out of contact with the other side of the string of interconnected packing cushions, wherein said first and second moving surfaces are belts.

2. The apparatus of claim 1 wherein said first and second moving surfaces are endless belts, each said endless belt traveling around a respective pair of rollers.

3. The apparatus of claim 1 wherein the packing cushions are air filled plastic pillows.

4. The apparatus of claim 3 further including transverse seal lines between adjacent ones of the air filled plastic pillows.

5. The apparatus of claim 4 further including transverse lines of weakening between adjacent ones of the air filled plastic pillows.

6. The apparatus of claim 5 wherein said transverse lines of weakening are perforations.

7. The apparatus of claim 5 wherein said transverse lines of weakening are slits.

8. The apparatus of claim 5 wherein said transverse lines of weakening are scoring.

9. The apparatus of claim 5 wherein said transverse lines of weakening are thinning.

10. Apparatus for producing a string of interconnected packing cushions, said apparatus comprising:

a packing cushion production machine which produces a string of interconnected packing cushions, the string of interconnected packing cushions exiting an output end of said machine at a first velocity, and a separation device associated with said output end of said machine, said separation device adapted to selectively engage the string of interconnected packing cushions and to drive the string at a second velocity, greater than the first velocity, and in doing so to cause the string of interconnected packing cushions to separate, wherein said separation device comprises:

first and second pairs of opposed moving surfaces, said first pair of opposed moving surfaces comprising a first moving surface adapted to contact one side of the string of interconnected packing cushions and a second moving surface adapted to contact the other side of the string of interconnected packing cushions, said first pair of opposed moving surfaces advancing the string of interconnected packing cushions the first velocity, said second pair of opposed moving surfaces comprising a third moving surface adapted to contact the one side of the string of interconnected packing cushions and a fourth moving surface adapted to be selectively placed into and out of contact with the other side of the string of interconnected packing cushions, said second pair of opposed moving surfaces advancing the string of interconnected packing cushions the second velocity, the second velocity being greater than the first velocity, whereby when said fourth moving surface is placed into contact with the other side of the string of interconnected packing cushions the string of interconnected packing cushions separates, wherein said first and second pairs of moving surfaces are belts.

11. The apparatus of claim 10 wherein said first and second pairs of moving surfaces are endless belts, each said endless belt traveling around a respective pair of rollers.

12. The apparatus of claim 10 wherein said fourth moving surface is manually placeable into and out of contact with the string of interconnected packing cushions via an operator.

13. The apparatus of claim 10 further comprising an actuator operably mounted between said packing cushion production machine and said fourth moving surface for placing said fourth moving surface into and out of contact with the string of interconnected packing cushions and a counting device which times activation of said actuator in order to obtain a selected length of the interconnected packing cushions.

14. The apparatus of claim 13 wherein said actuator is a solenoid.

15. The apparatus of claim 13 wherein said counting device is a timer.

16. The apparatus of claim 13 wherein said counting device is an encoder.

17. The apparatus of claim 10 further comprising:

an actuator operably mounted between said packing cushion production machine and said fourth moving surface for moving said fourth moving surface into and out of contact with the string of interconnected packing cushions, a counting device which times activation of said actuator in order to obtain a selected length of the interconnected packing cushions, and a processor/controller which receives a signal from said counting device and sends a signal to said actuator in response thereto to activate said actuator in order to obtain the selected length of the interconnected packing cushions.

18. The apparatus of claim 17 wherein said actuator is a solenoid.

19. The apparatus of claim 17 wherein said counting device is a timer.

20. The apparatus of claim 17 wherein said counting device is an encoder.

21. A method for producing a string of interconnected packing cushions, the method comprising:

producing a string of interconnected packing cushions, the string of interconnected packing cushions traveling at a first velocity, and selectively engaging the string of interconnected packing cushions at a second velocity, greater than the first velocity, and in doing so causing the string of interconnected packing cushions to separate, wherein the step of selectively engaging the string of interconnected packing cushions at the second velocity comprises engaging opposite surfaces of the string of interconnected packing cushions with a pair of opposed moving surfaces which are belts so as to advance the string of interconnected packing cushions at the second velocity.

22. The method of claim 21 wherein the step of producing a string of interconnected packing cushions comprises producing a string of interconnected air filled plastic pillows.

23. The method of claim 22 wherein the step of producing a string of interconnected air filled plastic pillows further includes the step of providing transverse seal lines between adjacent ones of the air filled plastic pillows.

24. The method of claim 23 wherein the step of producing a string of air filled plastic pillows with transverse seal lines between adjacent ones of the air filled plastic pillows further includes providing transverse lines of weakening between adjacent ones of the air filled plastic pillows.

25. The method of claim 24 wherein the transverse lines of weakening are perforations.

26. The method of claim 24 wherein the transverse lines of weakening are slits.

27. The method of claim 24 wherein the transverse lines of weakening are scoring.

28. The method of claim 24 wherein the transverse Lines of weakening are thinning.

29. Apparatus for producing a string of interconnected packing cushions, said apparatus comprising:

a packing cushion production machine which produces a string of interconnected packing cushions, the string of interconnected packing cushions exiting an output end of said machine at a first velocity, and a separation device associated with said output end of said machine, said separation device adapted to selectively engage the string of interconnected packing cushions and to drive the string at a second velocity, greater than the first velocity, and in doing so to cause the string of interconnected packing cushions to separate, wherein said separation device comprises a first moving surface adapted to contact one side of the string of interconnected packing cushions and a second moving surface adapted to contact the other side of the string of interconnected packing cushions, wherein said first and second moving surfaces are belts.

30. Apparatus for producing a string of interconnected packing cushions, said apparatus comprising:

a packing cushion production machine which produces a string of interconnected packing cushions, the string of interconnected packing cushions exiting an output end of said machine at a first velocity, and a separation device associated with said output end of said machine, said separation device adapted to selectively engage the string of interconnected packing cushions and to drive the string at a second velocity, greater than the first velocity, and in doing so to cause the string of interconnected packing cushions to separate, wherein said separation device comprises:

first and second pairs of opposed moving surfaces, said first pair of opposed moving surfaces comprising a first moving surface adapted to contact one side of the string of interconnected packing cushions and a second moving surface adapted to contact the other side of the string of interconnected packing cushions, said first pair of opposed moving surfaces advancing the string of interconnected packing cushions a first velocity, said second pair of opposed moving surfaces comprising a third moving surface adapted to contact the one side of the string of interconnected packing cushions and a fourth moving surface adapted to contact the other side of the string of interconnected packing cushions, said second pair of opposed moving surfaces advancing the string of interconnected packing cushions a second velocity, the second velocity being greater than the first velocity, wherein said first and second pairs of moving surfaces are belts.

* * * * *

UNITED STATES PATENT AND TRADEMARK OFFICE

CERTIFICATE OF CORRECTION

PATENT NO. : 7,571,589 B2
APPLICATION NO. : 10/891850
DATED : August 11, 2009
INVENTOR(S) : Shaw et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1363 days.

Signed and Sealed this

Seventh Day of September, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,571,589 B2
APPLICATION NO. : 10/891850
DATED : August 11, 2009
INVENTOR(S) : Kenneth Shaw and Adolf Wegmann It is certified that error appears in the above-identified patent and that said Letters Patent is hereby corrected as shown below:

Cover Page of Patent, Column 2, FOREIGN PATENT DOCUMENTS, lines 13-15 should be added to read:

-- CH 574844 4/1976 --
-- EP 0836926 A3 4/1998 --
-- DE 4302567 3/1994 --

Cover Page of Patent, Column 2, OTHER PUBLICATIONS section should be added as follows:

-- OTHER PUBLICATIONS --

-- Andrew Perkins, U.S. Patent Application Publication US 2005/0160699 A1, filed 01/27/04, published 07/28/05, Class 53, Subclass 403 --
-- Robert A. White, Jr. et al, U.S. Patent Application Publication US 2005/055987 A1, filed 09/12/03, published 03/17/05, Class 53, Subclass 495 --

Signed and Sealed this

Twelfth Day of October, 2010

David J. Kappos

David J. Kappos
*Director of the United States Patent and Trademark Office*